US006988914B2

(12) United States Patent
Pepe et al.

(10) Patent No.: US 6,988,914 B2
(45) Date of Patent: Jan. 24, 2006

(54) ELECTRICAL COUPLER WITH SPLITTING RECEPTACLE JACK INTERFACES

(75) Inventors: Paul John Pepe, Clemmons, NC (US); Linda Ellen Bert, Camp Hill, PA (US); Ralph Sykes Martin, Mount Airy, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/464,393

(22) Filed: Jun. 17, 2003

(65) Prior Publication Data

US 2004/0180580 A1 Sep. 16, 2004

Related U.S. Application Data

(60) Provisional application No. 60/455,025, filed on Mar. 14, 2003.

(51) Int. Cl.
*H01R 25/00* (2006.01)

(52) U.S. Cl. ..... 439/638; 439/76.1

(58) Field of Classification Search ..... 439/638, 439/344, 362, 654, 736, 676, 655, 701, 686, 439/687, 76.1, 79
See application file for complete search history.

(56) References Cited

U.S. PATENT DOCUMENTS 4,738,635 A * 4/1988 Harrington et al. ..... 439/452
4,740,172 A * 4/1988 Tubbs ..... 439/344
4,806,117 A * 2/1989 Johnston ..... 439/344
4,817,283 A * 4/1989 Johnston et al. ..... 29/884
4,904,209 A * 2/1990 Nelson ..... 439/676
5,178,554 A * 1/1993 Siemon et al. ..... 439/188
5,199,896 A * 4/1993 Mosquera ..... 439/329
5,651,690 A * 7/1997 Klas et al. ..... 439/352
5,759,067 A * 6/1998 Scheer ..... 439/607
6,171,152 B1 * 1/2001 Kunz ..... 439/620
6,328,595 B1 * 12/2001 Chang ..... 439/490
6,343,957 B1 * 2/2002 Kuo et al. ..... 439/638
6,364,713 B1 * 4/2002 Kuo ..... 439/638
6,383,028 B1 * 5/2002 Chang ..... 439/638
6,514,086 B2 * 2/2003 Liao ..... 439/676
6,558,207 B1 * 5/2003 Pepe et al. ..... 439/862
6,641,443 B1 * 11/2003 Itano et al. ..... 439/676

* cited by examiner

*Primary Examiner*—P. Austin Bradley
*Assistant Examiner*—Phuongchi Nguyen

(57) ABSTRACT

An electrical coupler includes a first housing having at least one receptacle jack. A second housing is coupled to the first housing, and the second housing includes at least a pair of receptacle jacks corresponding to the at least one receptacle jack. A splitter assembly extends between the first and second housing, and the splitter assembly includes a plurality of contacts located in each of the receptacle jacks. The splitter assembly includes a printed circuit board adapted to split input signals to said at least one receptacle jack to each of the pair of receptacle jacks. One of the first and second housings is adapted for mounting the coupler to a panel.

18 Claims, 7 Drawing Sheets

ELECTRICAL COUPLER WITH SPLITTING RECEPTACLE JACK INTERFACES

CROSS REFERENCE TO RELATED APPLICATIONS

This application claims the benefit of U.S. Provisional Patent Application Ser. No. 60/455,025 filed Mar. 14, 2003, which is hereby incorporated by reference in its entirety.

BACKGROUND OF THE INVENTION

This invention relates generally to electrical couplers, and more specifically, to electrical couplers capable of splitting signal inputs to an input receptacle jack to a pair of output receptacle jacks.

A rising number of increasingly complicated networked devices in voice and data communication systems presents several challenges to interconnecting the network of devices. In particular, a number of switching devices and switching equipment facilitate operation of the network, and connecting a large number of network devices to the switching devices is problematic. The switch devices and equipment are typically configured for a predetermined number of connections, and the limited capacity of the switching equipment for connections has been met. While higher capacity switching devices may be employed, replacing lower capacity yet functional switching devices with newer switching equipment is an expensive solution, and in light of the number of switching devices that exists in the network, replacing the switching equipment may not be a feasible option.

Even for existing equipment, connecting a large number of network devices to the switches can be difficult due to physical space limitations in the area proximate the switching devices and equipment. Also, as the number of connections increases, accommodation of the cables associated with the connections can become unmanageable in the vicinity of the switches. Especially in high-speed data transmission systems, these problems can become acute.

In some systems, couplers have been employed to combine two high-speed data applications in a single cable. The couplers include dual receptacle jacks connected to a single edge card connector. The edge card connector plugs into an outlet which is, in turn, coupled to the cable. When connected to the respective receptacle jacks, two networked devices (e.g., laptop PC's) running high speed data applications may be supported by a single cable, sometimes referred to as a "shared-sheath" application. While shared-sheath applications may be effective in reducing the number of cables in a network, accommodating a large number of connections to known switching devices remains problematic.

BRIEF DESCRIPTION OF THE INVENTION

In accordance with an exemplary embodiment of the invention, an electrical coupler comprises a first housing comprising at least one receptacle jack. A second housing is coupled to the first housing, and the second housing comprises at least a pair of receptacle jacks corresponding to the at least one receptacle jack. A splitter assembly extends between the first and second housing, and the splitter assembly comprises a plurality of contacts located in each of the receptacle jacks.

In an exemplary embodiment, the splitter assembly includes a printed circuit board adapted to split input signals to the at least one receptacle jack to each of the pair of receptacle jacks. The receptacle jacks are each RJ45 jacks for pluggable connection to switching equipment and to networked devices. Two network devices may therefore be connected to switching equipment through the coupler. One of the first and second housings is adapted for mounting the coupler to a panel. A plurality of couplers can be mounted to a panel assembly in use.

In accordance with another exemplary embodiment of the invention, an electrical coupler is provided. The coupler comprises a splitter assembly comprising a plurality of contact arrays and a plurality of contacts located on each contact array. The contact arrays include an input contact array and first and second output contact arrays. A portion of the contacts on the input array are coupled to a portion of the contacts on the first output array, and a portion of the contacts on the input array are coupled to a portion of the contacts on the second output array. A first jack interface receives the input contact array, and a second jack interface receives the first and second output contact arrays.

DETAILED DESCRIPTION OF THE INVENTION

Figure 1:
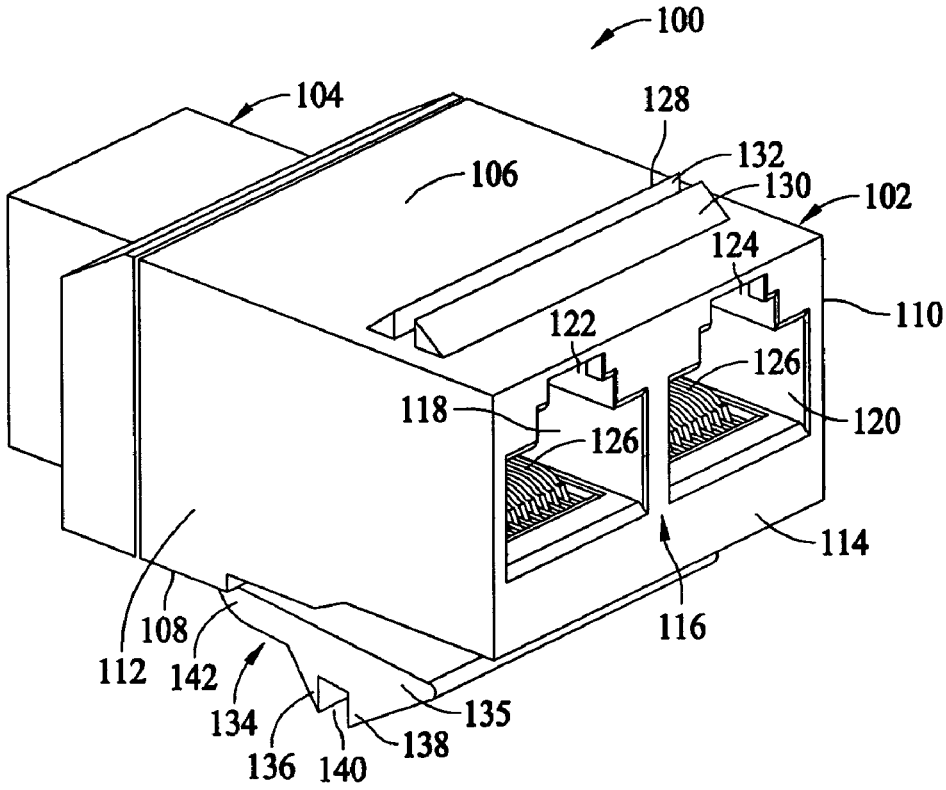
FIG. 1 is a front perspective view of an electrical coupler according to an embodiment of the present invention.

FIG. 1 is a front perspective view of an electrical coupler 100 formed in accordance with an exemplary embodiment of the present invention. As explained in detail below, coupler 100 provides expanded connection capability with existing switching devices and equipment. While coupler 100 is particularly suited for high-speed data transmission systems, it is recognized that the benefits and advantages of coupler 100 may accrue to other applications as well. The description set forth below is therefore provided for illustrative purposes only, and is not intended to limit the invention to any particular end use application.

Coupler 100 includes a front housing 102 and a rear housing 104. The front housing 102 is fabricated from a known plastic material according to known processes and techniques and is generally rectangular in the illustrated embodiment. Thus, the front housing 102 includes a top wall 106, a bottom wall 108, side walls 110, 112 extending between the top wall 106 and the bottom wall 108, and a front wall 114 defining a jack interface 116. The jack interface 116 includes a pair of receptacle jacks 118, 120 horizontally aligned with one another in a side-by-side arrangement. The receptacle jacks 118, 120 extend inward from the front wall 114 and are adapted to receive a known mating plug connector (not shown) coupled to a cable (not shown). The receptacle jacks 118, 120 each have a channel 122, 124 along one side thereof and the channels 118, 120 are configured to receive respective flexible prongs extending from the front end of the plug connector. When the plug is inserted into the receptacle, the prong retains the plug within the respective receptacle jack 118, 120.

The cable contains several signal wires that may, in different embodiments, be shielded or unshielded and made of fiber optics or copper. The signal wires in the cable are coupled to contacts 126 in the respective receptacle jack 118, 120 when the associated plug is connected thereto. In an exemplary embodiment, the cable includes eight signal wires, each of which is coupled to one of the contacts 126. Additionally, the eight signals wires are arranged in four pairs corresponding to pairs of contacts 126 in the receptacle jacks 118, 120. It is recognized, however, that cables having greater or fewer signal wires and greater or fewer numbers of signal pairs may be employed in alternative embodiments of the invention with appropriate modification to contacts 126 in the receptacle jacks. In one embodiment, the receptacle jacks 118, 120 are known RJ45 jacks configured to mate with known connector plugs, although it is appreciated that a variety of known receptacles and plugs may be employed in various embodiments of the invention.

The top wall 106 of the front housing 102 includes projecting ridges 128, 130 extending generally parallel to one another and defining a slot 132 therebetween. In the illustrated embodiment, the ridges 128, 130 are substantially triangular in cross section, although it is appreciated that other shapes and configurations of ridges 128, 130 may be employed in alternative embodiments of the invention. The bottom wall 108 of the front housing 102 has a stepped contour and a resilient latch member 134 extending therefrom. The latch member 134 extends beneath the bottom wall 108 and includes a planar body portion 135 extending substantially parallel to the top wall 106. The body portion 135 of the latch member 135 includes projecting ridges 136, 138 extending outwardly and downwardly from the body portion 135. The ridges 136, 138 on the latch member 134 are positioned opposite one another and form a slot 140 extending therebetween. Like the ridges 128, 130 in the top wall 106, the ridges 136, 138 in the latch member are substantially triangular in cross section, although it is understood that ridges 136, 138 may be differently shaped in alternative embodiments. Additionally, it is contemplated that ridges 128, 130, 136, 138 need not have a similar shape to one another in further and/or alternative embodiments of the invention.

The slot 132 in the top wall 106 and the slot 140 in the latch member 134 are substantially aligned with one another so that the front housing 102 may be supported on a panel (not shown in FIG. 1) in use. The stepped contour of the bottom wall 108 provides a clearance for pivotal movement of the latch member 134 about an end 142 of the latch member 134 extending from the bottom wall 108. Mounting of the coupler 100 to the panel is described further below.

Figure 2:
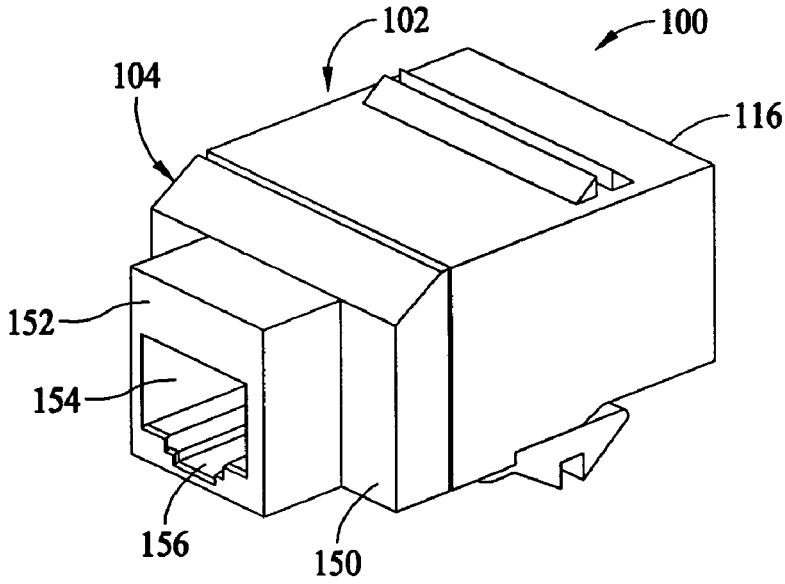
FIG. 2 is a top rear perspective view of the coupler shown in FIG. 1.

FIG. 2 illustrates the rear housing 104 extending from the front housing 102 opposite the jack interface 116. The rear housing 104 is fabricated from a known plastic material and includes a cap portion 150 and a jack interface 152. The cap portion 150 encloses a rear end of the front housing 102, and the jack interface 152 extends outwardly from the cap portion 150. The jack interface 152 includes a receptacle jack 154 approximately centered in the cap portion 154 and oriented 180° from the jack interface 116 of the front housing 102. That is, while the front housing 102 includes forward facing receptacle jacks 118, 120, (shown in FIG. 1) the rear housing 104 includes a rearward facing receptacle jack 154. While the oppositely facing receptacle jacks on the front housing 102 and the rear housing 104 are believed to be advantageous, it is appreciated that the receptacle jacks on the front and rear housing 102, 104 may be otherwise oriented relative to one another in alternative embodiments of the invention.

The receptacle jack 154 of the rear housing 104 extends inward from the jack interface 152 and is adapted to receive a known mating plug connector (not shown) coupled to a cable (not shown). The receptacle jack 154 has a channel 156 along one side thereof and the channel 156 is configured to receive a respective flexible prong extending from the front end of a plug connector (not shown) inserted into the receptacle to retain the plug connector to the receptacle jack 154.

Figure 3:
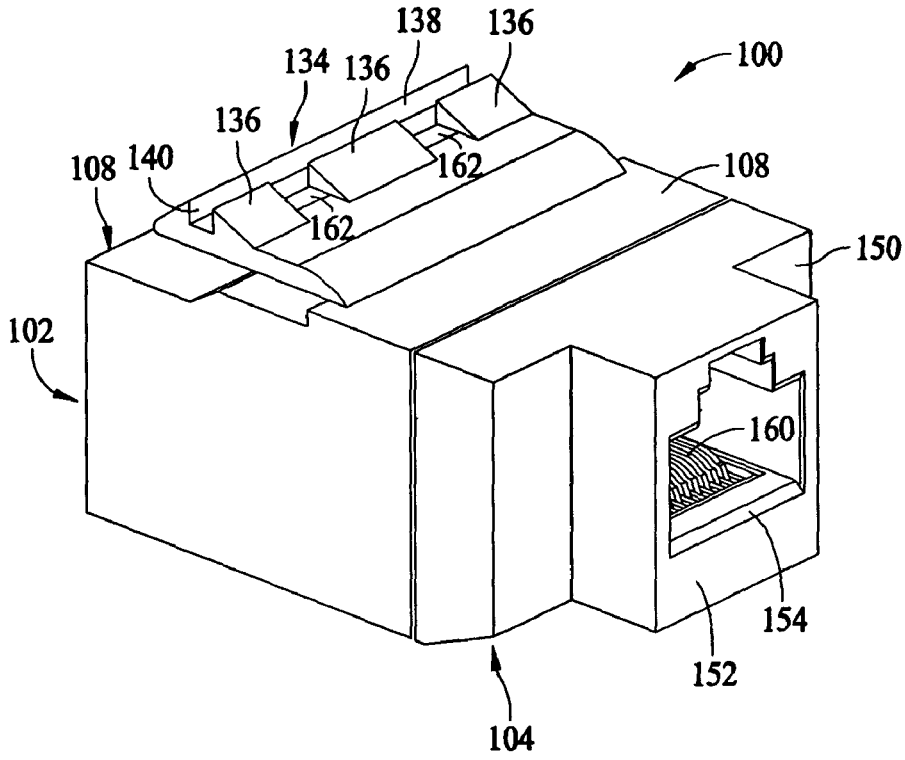
FIG. 3 is a bottom rear perspective view of the coupler shown in FIG. 1.

FIG. 3 illustrates contacts 160 situated within the receptacle jack 154 of the rear housing 104. The contacts 160 establish electrical connection with signal wires of a cable coupled to a plug connector. In different embodiments, the cable may be shielded or unshielded and made of fiber optics or copper. The signal wires in the cable are coupled to the contacts 160 in the receptacle jack 154 when the plug is connected thereto. In an exemplary embodiment, the cable includes eight signal wires, each of which is coupled to one of the contacts 160. Additionally, the eight signal wires are arranged in four pairs corresponding to pairs of contacts 160. It is recognized that cables having greater or fewer signal wires and greater or fewer numbers of pairs may be employed in alternative embodiments of the invention with appropriate modification to contacts 160 in the receptacle jack 154. In one embodiment, the receptacle jack 154 is a known RJ45 jack configured to mate with a known connector plugs, although it is appreciated that a variety of known receptacles and plugs may be employed in various embodiments of the invention.

When a cable is coupled to the receptacle jack 154 in the rear housing 104, the input signals received by the contacts 160 are split into the receptacle jacks 118, 120 (shown in FIG. 1) in the front housing 102. Thus, when the receptacle jack 154 is coupled to a cable in line with a switching device/equipment (not shown), two network devices may be connected, respectively, to the receptacle jacks 118, 120 in the front housing 102. Thus, with one cable connection to the switching device via receptacle jack 154, two network devices may be switched via the receptacle jacks 118, 120 output from the coupler 100, thereby expanding the number of potential connections to the switching device/equipment. Additionally, connections to the coupler 100 may be made in a remote location from the switching device or switching equipment, thereby improving accessibility to the cable connector plugs and alleviating crowded connections to the switching device/equipment in a relatively small amount of space.

Also, as illustrated in FIG. 3, the latch member 134 attached to the bottom wall 108 of the front housing 102 extends substantially the longitudinal length of the front housing 102. Ridge 138 is substantially solid and extends the length of the latch member 134, while the ridge 136 includes gaps 162 therein exposing the slot 140 extending between the ridges 136, 138. The gaps 162 facilitate mounting of the coupler 100 to a panel, as further described below.

Figure 4:
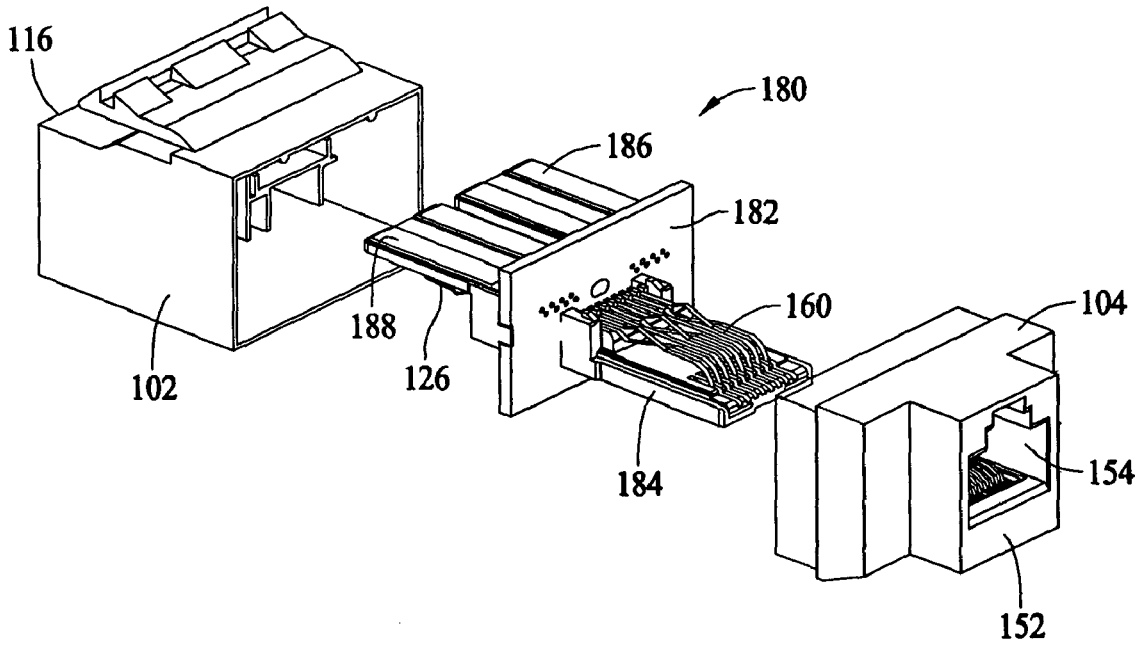
FIG. 4 is an exploded bottom rear perspective view of the coupler shown in FIG. 1.
Figure 5:
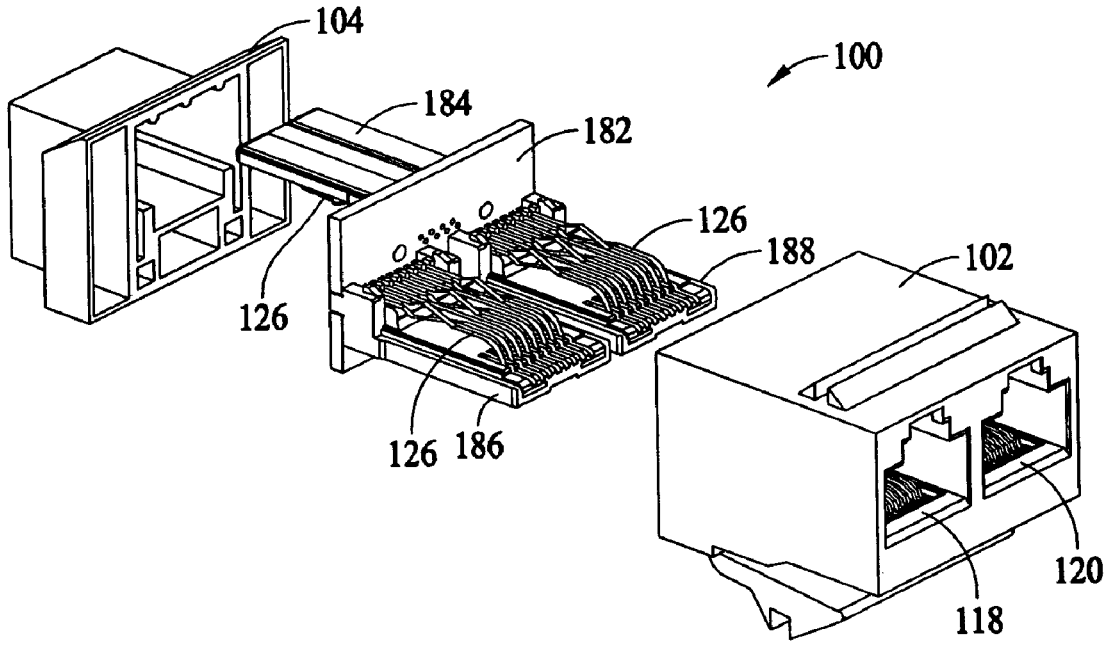
FIG. 5 is an exploded top front perspective view of the coupler shown in FIG. 1.

FIGS. 4 and 5 illustrate a splitter assembly 180 extending between the front housing 102 and the rear housing 104. The splitter assembly 180 includes a printed circuit board 182, a rear contact array 184 extending from one side of the printed circuit board 182, and a pair of front contact arrays 186, 188 extending from the other side of the printed circuit board 182 opposite the rear contact array 184. The contact arrays 184, 186, 188 extend substantially perpendicular to the printed circuit board 182 and hold the respective contacts 160, 126 of the front and rear receptacle jacks in the rear housing 104 and the front housing 102. The contacts 126, 160 are coupled to conductive traces on the printed circuit board 182 which splits, for example, a four pair contact signal input to the receptacle jack 154 in the rear housing 104 to a two pair contact output signal in each of the receptacle jacks 118, 120 in the rear housing. Additionally, in an exemplary embodiment, the printed circuit board 182 includes known components to process the input signals as desired to boost signal strength, attenuate noise, etc. as those in the art will appreciate.

The contact arrays 184, 186, 188 are fabricated from an insulative material, such as plastic, and are shaped and dimensioned to be received and retained in respective cavities in the front housing 102 and the rear housing 104. When the coupler 100 is assembled, the contacts 160, 126 are located in the respective receptacle jacks in the respective rear and front housings 104, 102.

Figure 6:
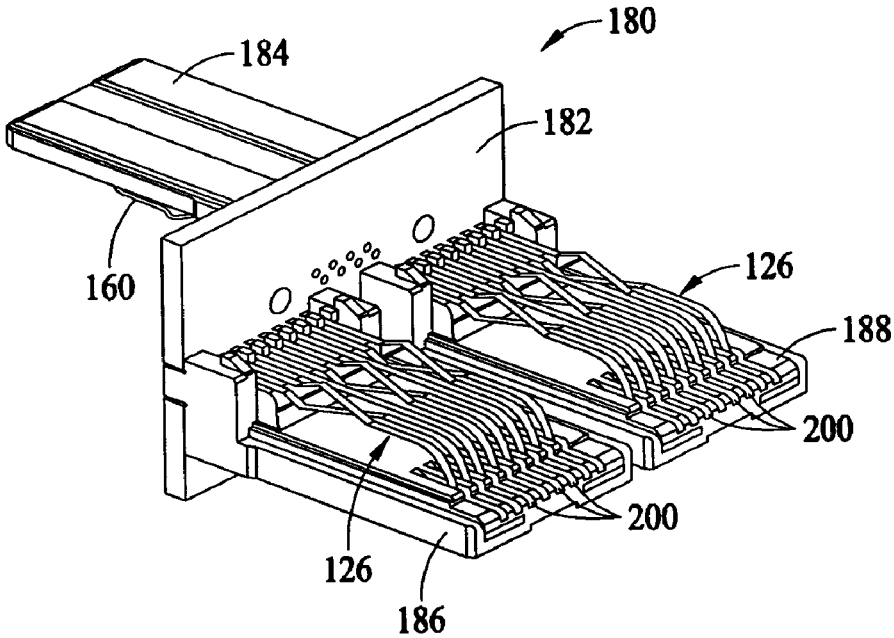
FIG. 6 is a front perspective view of a splitter assembly for the coupler shown in FIG. 1.

FIG. 6 is a magnified view of the splitter assembly 180 illustrating the contacts 126 situated on the contact arrays 186, 188. The contacts 126 include rounded distal ends situated in slots 200 extending longitudinally in a forward end of the contact arrays 186, 188. Each of the contacts 126 is terminated at an opposite end to the printed circuit board 126 via through-hole terminations to establish electrical connection to circuitry on the printed circuit board 182. Intermediate the rounded ends and the terminations, selected contact pairs of the contacts 126 cross over one another for enhanced signal transmission and reduced noise. Contacts 160 are arranged similarly on contact array 184 as contacts 126 are arranged on the contact arrays 186, 188.

As illustrated in FIG. 6, the contacts 126, 160 face opposite directions from one another on either side of the printed circuit board 182. In other words, while the contacts 126 extend on the top surface of the front contact arrays 186, 188, the contacts 160 extend on the bottom surface of the rear contact array 184. Stated another way, if the contacts 126 are located in the bottom of the receptacle jacks 118, 120 on the front housing 102, the contacts 160 are located in the top of the receptacle jack 154 in the rear housing 104. As such, the receptacle jacks 118, 120 are inverted relative to the receptacle jack 154.

Figure 7:
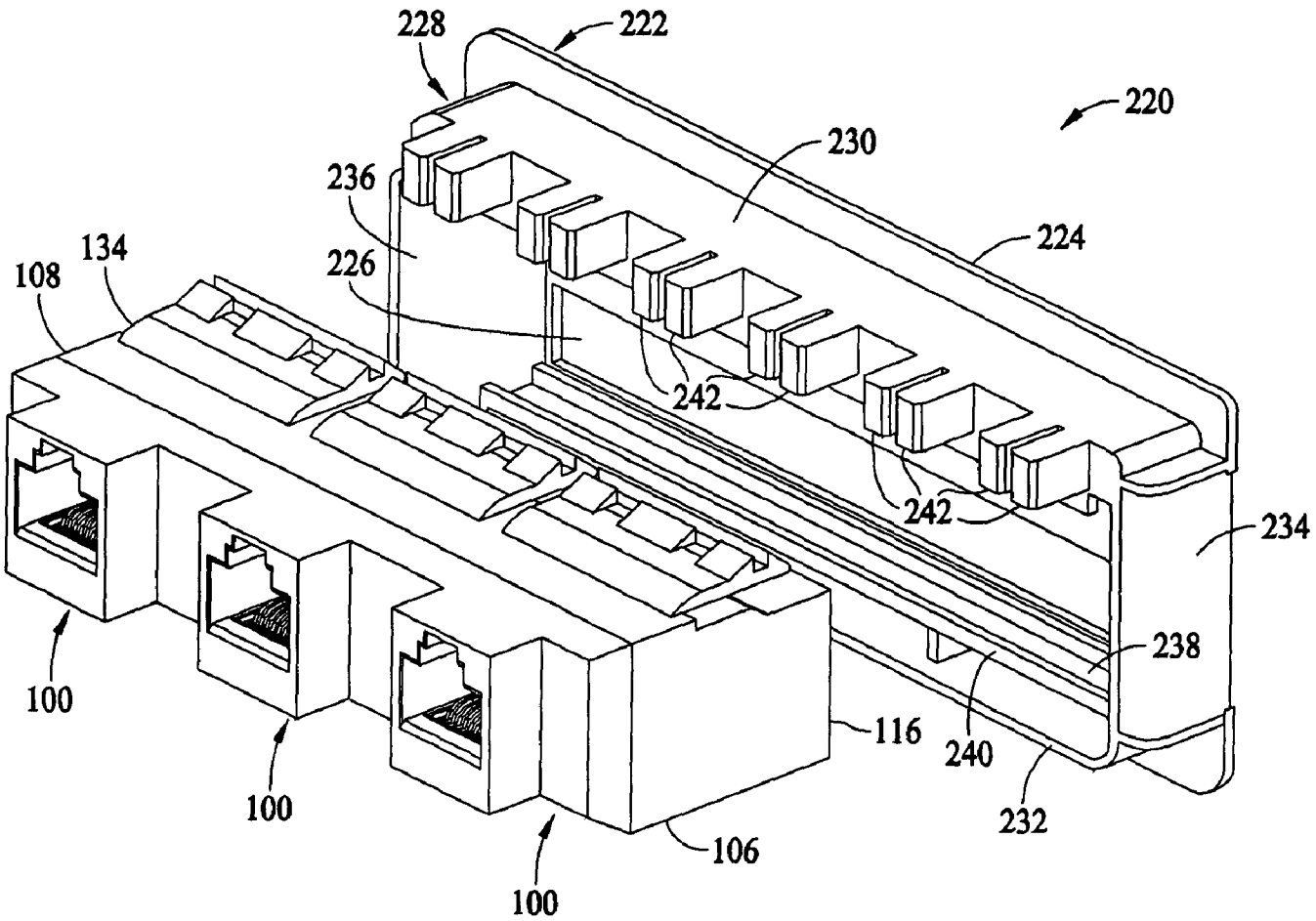
FIG. 7 is an exploded perspective view of a coupler system employing the coupler shown in FIG. 1.

FIG. 7 is an exploded view of a coupler system 220 including a panel assembly 222 and a plurality of couplers 100. The panel assembly 222 includes a flat front panel 224 having an opening or cutout 226 therethrough, and a frame 228 extends inward from the front panel 224 and surrounds the opening 226. The frame 228 includes a bottom wall 230, a top wall 232, and side walls 234, 236 defining a receptacle for receiving the couplers 1100. A shelf 238 extends across the upper end of the opening 226 in a spaced apart relationship from the top wall 232. The shelf 238 includes a ridge 240 on one side thereof that engages the slot 132 (shown in FIG. 1) on each of the top walls 106 of the couplers 100. The bottom wall 230 of the frame 228 includes outwardly projecting fingers 242 extending rearwardly therefrom. The fingers 242 are received in the gaps 162 (shown in FIG. 3) in the ridge 136 (shown in FIG. 3) of the latch members 134 on the bottom wall 108 of the couplers 100.

Figure 8:
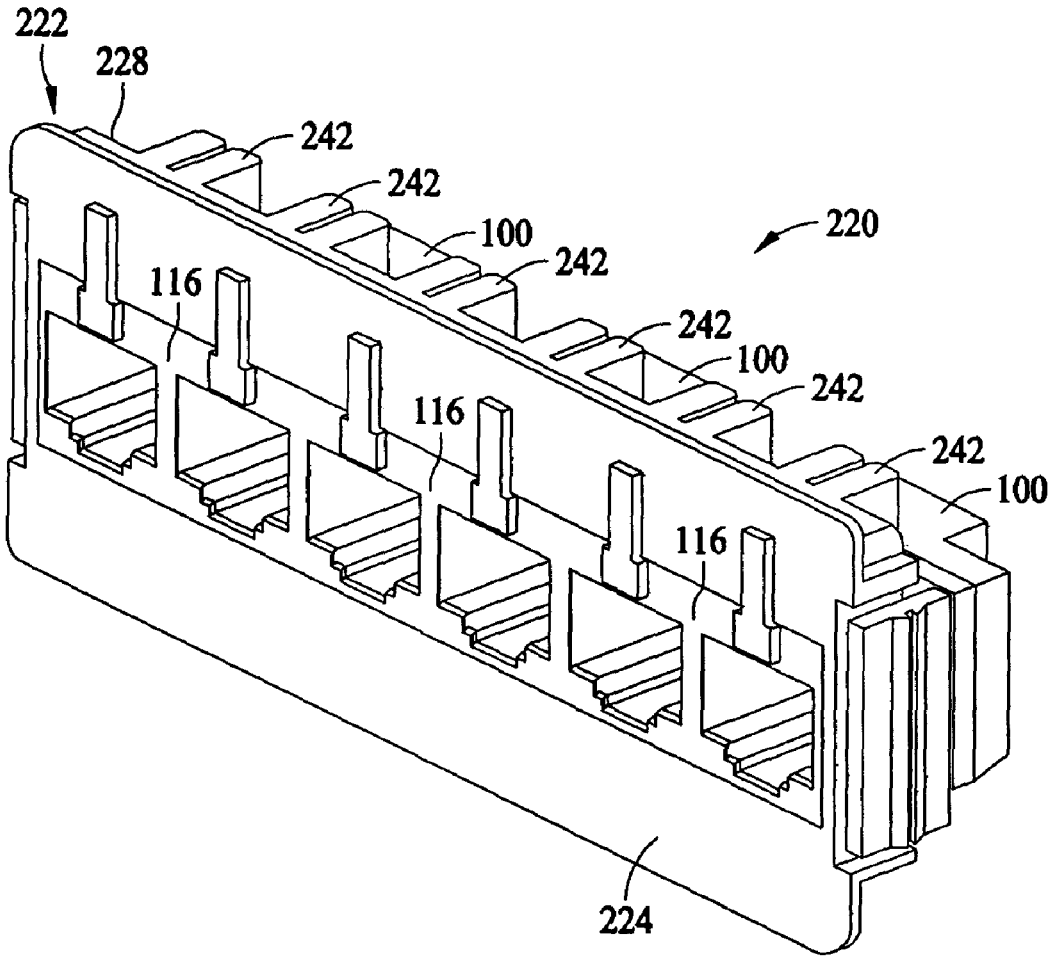
FIG. 8 is a perspective assembly view of the system shown in FIG. 7.

FIG. 8 illustrates the jack interfaces 116 of the couplers 100 received in the opening 126 in the flat panel. The ridge 240 (shown in FIG. 7) of the shelf 238 is located in the slots 132 (shown in FIG. 1) of the top wall 106 (shown in FIGS. 1 and 7) of each of the couplers 100. The latch members 134 of each of the couplers 100 are engaged to the fingers 242 of the frame 228. The fingers 242 deflect the latch member 134 of each coupler 100, causing the latch members 134 to pivot downward toward the bottom wall 108 of each coupler 100. Deflection of the latch members 134 provides a biasing force to retain the couplers 100 to the frame 228. By virtue of the slots 132 in the top wall 106 and the latch member 134 on the bottom wall 108 of each coupler 100, the couplers 100 are supported on the top and the bottom in the panel assembly 222 to securely mount the couplers 100 for use.

The panel assembly 222 may be located in a location remote from the switching device, and the couplers 100 may therefore be mounted in a convenient location for making connections to the switching device. The pluggable connections to the receptacle jacks 118, 120 and 154 simplifies installation of the couplers 100, while the couplers 100 double the number of connections otherwise available from the switching device.

Figure 9:
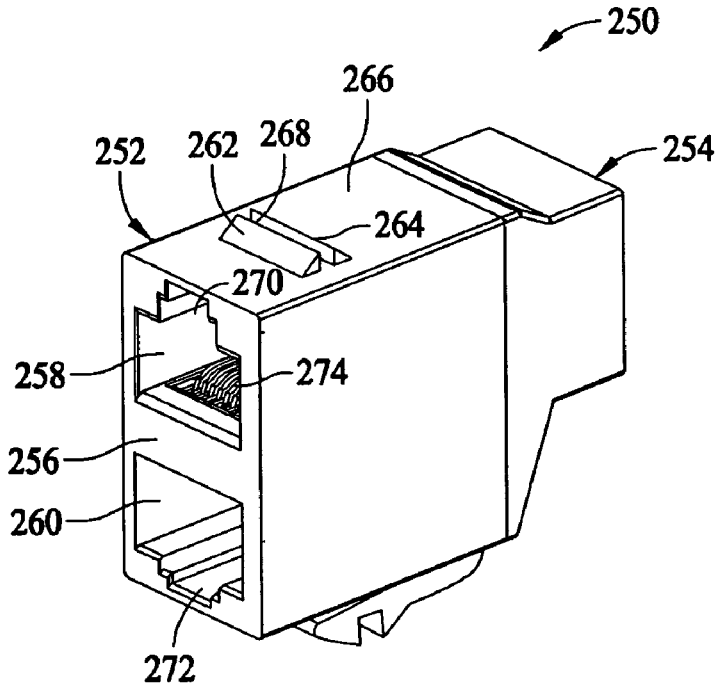
FIG. 9 is a top front perspective view of a coupler formed in accordance with another embodiment of the invention.
Figure 10:
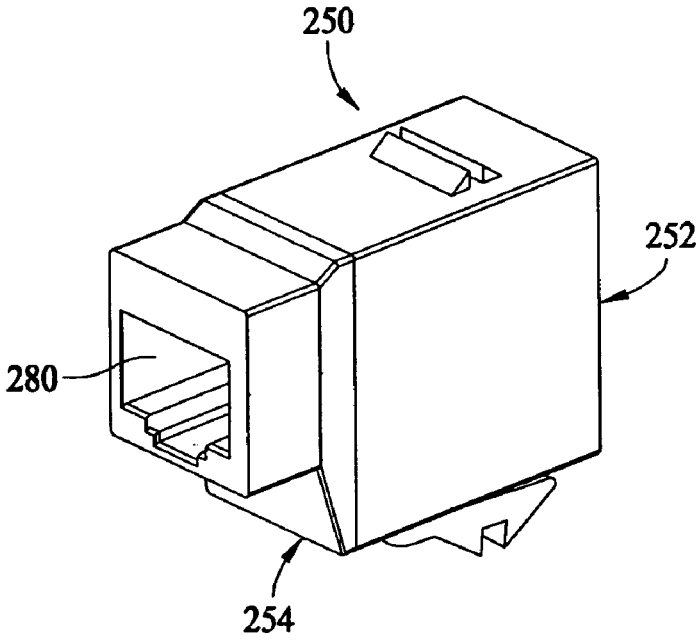
FIG. 10 is a top rear perspective view of the coupler shown in FIG. 9.
Figure 11:
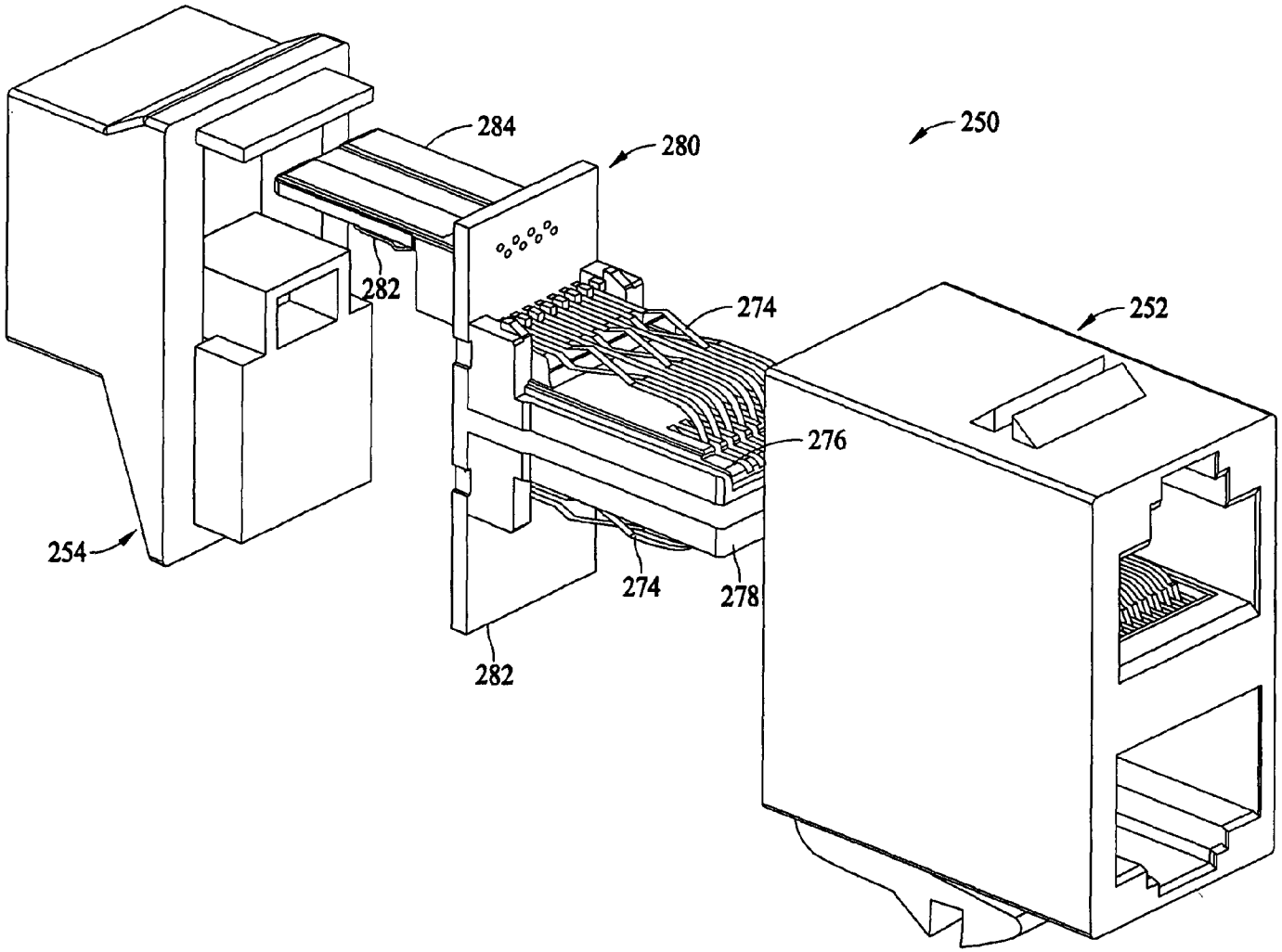
FIG. 11 is an exploded front perspective view of the coupler shown in FIG. 9.

FIGS. 9–11 illustrate another embodiment of a coupler 250 including a front housing 252 and a rear housing 254. The front housing 252 includes a jack interface 256 having a pair of receptacle jacks 258, 260 arranged vertically relative to one another in the jack interface 256. Ridges 262, 264 are formed in a top wall 266 of the front housing, and together define a slot 268 for supporting the coupler 250 in a panel assembly, such as panel assembly 222 shown in FIGS. 7 and 8.

The receptacle jacks 258, 260 in the front housing 252 each have a channel 270, 272 along one side thereof and the channels 270, 272 are configured to receive respective flexible prongs extending from the front end of a plug connector (not shown). When the plug is inserted into the receptacle, the prong retains the plug within the respective receptacle jack 258, 260. Contacts 274 are located in each of the receptacle jacks 258, 260. The receptacle jacks 258, 260 are inverted relative to one another so that the contacts 274 face in opposite directions on contact arrays 276, 278 (FIG. 11) of a splitter assembly 280. Contact arrays 276, 278 receive the contacts 274 and are fitted into receptacles in the front housing 252 to complete the receptacle jacks 258, 260.

The rear housing 254 includes a single receptacle jack 280 formed therein that is oppositely faced from the receptacle jacks 258, 260 of the front housing 252. Thus, while the receptacle jacks 258, 260 are forward facing, the receptacle jack 280 is rearward facing and oriented 180° from the receptacle jacks 258, 260. The receptacle jack 280 in the rear housing 254 includes contacts 282 therein and are arranged on a contact array 284 to establish an electrical connection with a plug connector of a cable that is connected to switching equipment. A printed circuit board 282 (shown in FIG. 11) includes circuit traces to connect the contacts 282 to the contacts 274 of the receptacle jacks 258, 260 of the front housing 252. The printed circuit board 282 is adapted to split the signals from the receptacle jack 280 to the receptacle jacks 258, 260 and provide any signal compensation desired.

A plurality of couplers 250 may be mounted to a panel assembly in substantially the same manner as described above. Coupler 250 provides substantially the same benefits and advantages as coupler 100 described above.

In each of the illustrated embodiments, coupler 100 and coupler 250 includes a front jack interface having two receptacle jacks, and a rear jack interface having one receptacle jack. It is understood, however, that in further embodiments more than one receptacle jack could be provided in the rear housing, with each of the receptacle jacks in the rear housing corresponding to a pair of receptacle jacks in the front housing. For example, two receptacle jacks may be provided in the rear housing and four receptacle jacks provided in the front housing (i.e., two receptacle jacks for each of the receptacle jacks in the rear housing). As another example, three receptacle jacks may be provided in the rear housing with six receptacle jacks provided in the front housing. The receptacle jacks may be provided in practically any orientation, and are not limited to an aligned horizontal row or vertical column arrangement of the illustrated embodiments.

The versatility of the invention to conveniently accommodate connections of networked devices to existing switching equipment is now believed to be apparent. The relatively low cost coupler of the present invention provides a practical and affordable solution to the network connection issues discussed above.

While the invention has been described in terms of various specific embodiments, those skilled in the art will recognize that the invention can be practiced with modification within the spirit and scope of the claims.

What is claimed is:

1. An electrical coupler comprising:

a first housing comprising a first receptacle jack;

a second housing coupled to said first housing, said second housing comprising at least a pair of receptacle jacks corresponding to said first receptacle jack, one of said pair of receptacle jacks being inverted relative to said first receptacle jack; and a splitter assembly extending between said first and second housing, said splitter assembly comprising a plurality of contacts located in each of said first receptacle jack and said pair of jacks, wherein said contacts in said first receptacle jack are inverted relative to the contacts in said pair of jacks.

2. An electrical coupler in accordance with claim 1 wherein said splitter assembly comprises a printed circuit board adapted to split input signals to said first receptacle jack to each of the pair of receptacle jacks.

3. An electrical coupler in accordance with claim 1, wherein said first receptacle jack and said pair of receptacle jacks are oppositely facing.

4. An electrical coupler in accordance with claim 1, wherein said pair of receptacle jacks are oriented side-by-side.

5. An electrical coupler in accordance with claim 1, wherein said pair of receptacle jacks are oriented vertically relative to one another.

6. An electrical coupler in accordance with claim 1 wherein said first receptacle jack is an RJ45 jack.

7. An electrical coupler in accordance with claim 1 wherein said first receptacle jack and said pair of receptacle jacks is an RJ45 jack.

8. An electrical coupler in accordance with claim 1 wherein said pair of receptacle jacks are inverted relative to one another.

9. An electrical coupler in accordance with claim 1, at least one of said first and second housings adapted for mounting said coupler to a panel.

10. An electrical coupler in accordance with claim 1, at least one of said first and second housing comprising a pivotally mounted latch member, said latch member comprising opposite first and second ridges extending across a surface of said housing and defining a slot therebetween, one of said ridges including a gap which exposes said slot.

11. An electrical coupler comprising:

a splitter assembly comprising a plurality of contact arrays joined to one another and a plurality of contacts located on each contact array, said contact arrays including an input contact array and first and second output contact arrays, a subset of said contacts on said input array coupled to a portion of the contacts on said first output array, and a remaining subset of the contacts on said input array coupled to a portion of the contacts on the second output array;

a first jack interface receiving said input contact array; and a second jack interface receiving said first and second output contact arrays, wherein said splitter assembly extends between and occupies a portion of said first jack interface and said second jack interface, wherein said input contact ray is inverted relative to at least one of said first and second output contact arrays.

12. An electrical coupler in accordance with claim 11 wherein said splitter assembly comprises a circuit board separating said input contact array from said first and second output contact arrays, said input contact array extending from a first side of said printed circuit board, and said first and second output arrays extending from a second side of said circuit board opposite said first side.

13. An electrical coupler in accordance with claim 11, wherein said first jack interface and said second jack interface extend substantially 180° from one another.

14. An electrical coupler in accordance with claim 11, wherein said second jack interface comprises a pair of jack receptacles horizontally aligned with one another.

15. An electrical coupler in accordance with claim 11, wherein said second jack interface comprises a pair of jack receptacles vertically aligned with one another.

16. An electrical coupler in accordance with claim 11 wherein said first jack interface comprises an RJ45 receptacle jack.

17. An electrical coupler in accordance with claim 11 wherein said first and second output contact arrays are inverted relative to one another.

18. An electrical coupler in accordance with claim 11 further comprising a pivotally mounted latch member extending on a surface extending between said first jack interface and said second jack interface, said surface comprising a stepped contour to permit deflection of said latch member.

* * * * *